US005135217A

United States Patent [19]

Swain

[11] Patent Number: 5,135,217

[45] Date of Patent: Aug. 4, 1992

[54] BASKETBALL TRAINING DEVICE

[76] Inventor: Timothy C. Swain, P.O. Box 125, Fair Play, S.C. 29643

[21] Appl. No.: 515,717

[22] Filed: Apr. 27, 1990

[51] Int. Cl.[5] ..... A63B 69/00

[52] U.S. Cl. ..... 273/4.5 A; 482/46; 482/124; 482/48

[58] Field of Search ..... 273/1.5 A, 54 B, 189 R; 272/67, 139, 143

[56] References Cited

U.S. PATENT DOCUMENTS

| | | | |
|---|---|---|---|
| 2,022,910 | 12/1935 | Hanley | 273/189 R |
| 2,546,118 | 3/1951 | Wright | 272/67 X |
| 3,062,546 | 11/1962 | Horton et al. | 273/54 B |
| 3,858,881 | 1/1975 | Hurwitz | 273/189 R X |
| 3,880,426 | 4/1975 | Morse | 273/54 B |
| 4,026,549 | 5/1977 | Gunn | 272/67 |
| 4,359,221 | 11/1982 | Taylor | 273/54 B |
| 4,881,275 | 11/1989 | Cazares et al. | 272/67 X |
| 4,919,425 | 4/1990 | Wolf | 273/1.5 A |

FOREIGN PATENT DOCUMENTS

| | | | |
|---|---|---|---|
| 2112786 | 6/1972 | France | 272/143 |

*Primary Examiner*—Paul E. Shapiro
*Attorney, Agent, or Firm*—Cort Flint

[57] ABSTRACT

A training device (10) for developing proper shooting techniques for basketball players in which the wrist is held in the proper cocked position prior to shooting and returned to that position subsequent to shooting through the use of a yieldable tensioning member (C) secured between the upper arm and hand of the players by an arm connector (A) and hand connector (B).

15 Claims, 2 Drawing Sheets

BASKETBALL TRAINING DEVICE

BACKGROUND OF THE INVENTION

This invention relates to a training aid or device for developing proper shooting techniques for basketball players. The training device is intended to develop proper arm extension, follow through, and wrist action in the shooting motion of the basketball player.

Several training aids for assisting in the development of proper motions for various sports are known to the prior art. See for example, U.S. Pat. Nos. 2,022,910; 2,709,257; 3,249,359; and 4,575,089 all directed to training aids for assisting in the development of proper golf swings. These patents relate to various devices connected between the hand and arm to assist in their correct position during the golf swing. As there is no similarity between a golf swing which moves a club through an arc and requires the use of both hands and both arms and a basketball shot which requires the use of one arm and hand to propel a basketball, these devices are not seen as pertinent. The same is true of U.S. Pat. Nos, 3,858,881; 4,689,828; and 4,777,666 which are directed to aids for use with archers and tennis players. U.S. Pat. No. 4,383,685 to Bishop is concerned with basketball players, but is concerned with cumbersome equipment such as guide bars, training vest, etc. Such an arrangement does not concern with proper shooting techniques. Finally, U.S. Pat. No. 4,805,905 to Haub is directed to an aid for developing in basketball players proper follow through of the wrist hand and fingers upon release of a basketball. Haub, however, goes about this by providing a feeler element which is positioned adjacent to the wrist in position to touch the fingers if the wrist has gone through the proper shooting motion. This device is not concerned with proper pre-shooting position or with the return of the wrist to that position after shooting.

Accordingly, an object of the invention to provide a training device for basketball players for developing proper shooting techniques.

It is further an object of the invention to provide a training device comprising an elongated yieldable tension member which is removably positionable between the upper arm and hand of a basketball player and of a length so as to properly cock the wrist of the player prior to executing a shooting motion and to re-cock the wrist just subsequent to the execution of said shooting motion.

It is a further object of the invention to provide a training aid comprising an elongated tensioning member which is connected to a player's upper arm and corresponding hand so that when the elbow is pointed at the target, the wrist is cocked in proper shooting position, during the shooting motion, the wrist is allowed to move through the proper flip motion and subsequent to shooting motion, the wrist is re-cocked.

SUMMARY OF THE INVENTION

The above objectives are accomplished according to the invention by providing a basketball training device which develops proper shooting technique of a basketball player and includes an arm band secured about an upper arm of said player. A finger harness receives an index finger and middle finger of the corresponding hand. A yieldable tension member interconnects the arm band and the finger harness. A tension member is of a length so as to exert a pull bending the arm at its elbow and to cock the wrist toward the upper arm. The arm band comprises an inelastic, elongate member which is approximately three inches in length having opposite ends and means adjustably securing the ends relative to each other so as to form a closed loop. The securing means comprises a buckle assembly which connects adjacent one end of the elongate member and a belt connects adjacent the opposite end of the elongate member. The belt is of a sufficient length as to extend beyond the opposite end so as to be interconnectable with the buckle. A connector ring connects one edge of the elongate member and yieldable tension member extending through the ring. The yieldable tension member comprises an elastic strap. The elastic strap has a buckle secured adjacent one end thereof. The buckle is adapted to receive an opposite end of the strap so as to form a loop of adjustable length. The harness finger comprises a flat piece of relatively stiff material having first and second apertures formed therein. The first aperture is adapted to receive the index finger and the second aperture is adapted to receive the middle finger. In use, the arm band is secured to one upper arm of a basketball player, and tightened so as not to slip excessively. The finger harness is secured to the corresponding hand whereby the tensioning member exerts a tension pull bending the arm at its elbow and cocking the wrist toward the upper arm. When said player assumes a shooting position with the elbow pointed toward a target, the corresponding wrist is cocked toward the upper arm. The corresponding hand is held in a proper preshooting cocked position. The member allows the hand and arm to move through the proper shooting motion and then returns the arm and hand to the proper pre-shooting position.

These and other objects and advantages of the invention will become apparent to those skilled in the art from a study from the following detail descriptions and attached drawings upon which by way of example, only one preferred embodiment of the invention is described and illustrated.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
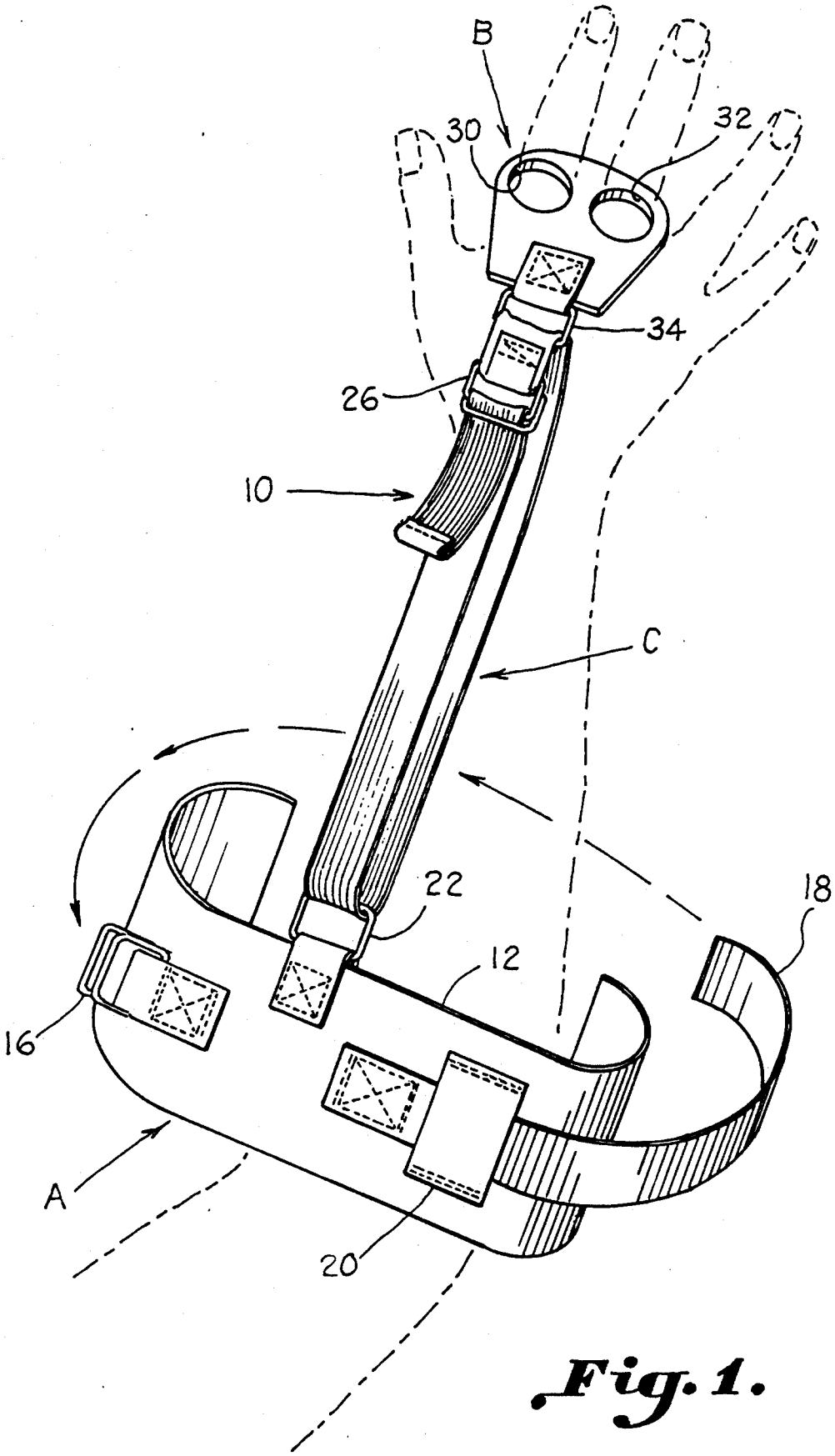
FIG. 1 is a perspective view of a preferred embodiment of the training device of the present invention.

Referring now to the drawings, there is shown one preferred embodiment of the invention, a training device 10 for developing proper shooting techniques for basketball players. Training device 10 includes a flexible, inelastic arm band A, a finger harness B and a yieldable tension member C interconnecting the two.

Flexible arm band A provides an arm connector means which includes an elongated strip or member 14 of approximately three inches in width and of a sufficient length to reach substantially around the upper arm area of a basketball player. Arm band A is constructed from a flexible, but non-elastic strip material s that it may be tightened about the upper arm without stretching to remain in place under the pull forces of tension member C. Strip or member 14 has a buckle assembly 16 attached thereto in the vicinity of one end and an inelastic belt 18 housing one of its ends attached in the vicinity of the other end. Strip 14 ma also have a positioning loop 20 attached thereto and associated with belt 18 to retain it in the proper position as shown in FIG. 1. A connector ring 22 is attached to one edge of arm band A at approximately its mid-point. Band A is preferably formed of synthetic woven material such as nylon, however, any band structure having sufficient strength for tightening about the arm, and an adjustable securing system is suitable.

Yieldable tensioning member C preferably consists of an elastic woven strap C having buckle assembly B secured to one end thereof is provided. Buckle assembly B is adapted to receive the opposite end of strap C so that in use the yieldable tensioning member is in the form of a loop of adjustable size. Any elastic member may be employed such as a spring or rubber means.

Finger harness B provides a hand connector means which may consist of a leather piece 28 having finger receiving apertures 30 and 32 arranged along one edge and a connector ring assembly 34 is secured adjacent the opposite edge behind and between the apertures. Strap C passes through right assembly 34 secured adjacent the opposite edge. Piece 28 is preferably formed of leather and is inelastic and relatively stiff. Aperture 30 is adapted to receive the index finger of the basketball player and aperture 32 is adapted to receive the corresponding middle finger. The fingers should fully penetrate apertures 30 and 32 so that piece 28 is engaged at the base of the fingers. It is also possible that a finger harness which harnesses both fingers without separation may be used; or that a glove covering both fingers may be used with a tension member secured directly behind the fingers. Strap C is arranged to extend coextensive with and substantially longitudinally of the forearm and hand at all times.

Strap C is received through ring assemblies 22 and 34 so as to interconnect band A and finger harness B at an adjustable distance.

Figure 3:
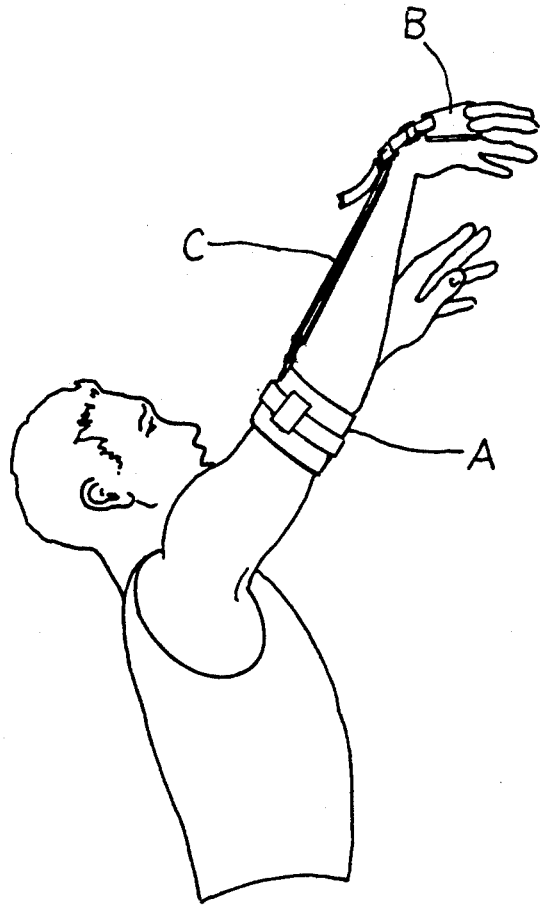
FIG. 3 shows the training device in use with the basketball player in the just-shot position.
Figure 2:
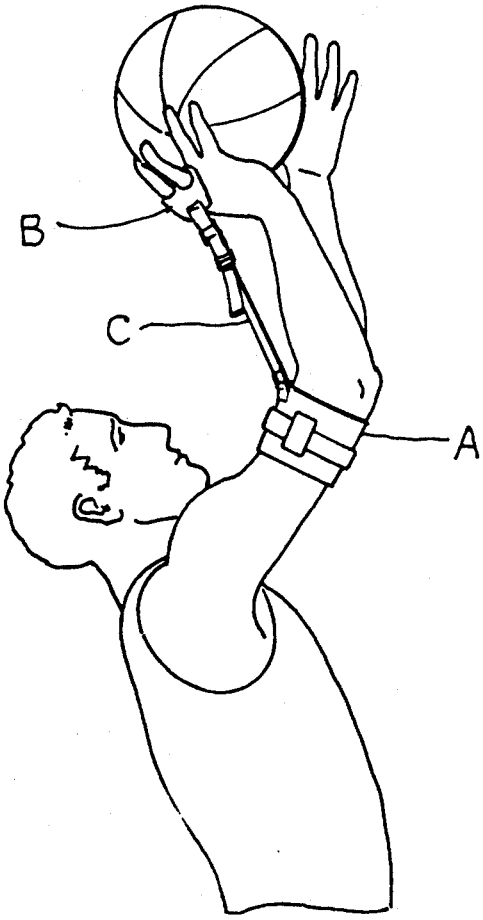
FIG. 2 shows the training device in use with the basketball player in the pre-shooting position.

Training device 10 is arranged on the shooting arm of a basketball player. Band A is secured in a stationary position to the upper arm of the player with ring 22 positioned adjacent the inner side of the elbow. Harness B is connected at the base of the index and the middle fingers with the shooting hand. Strap C is arranged so that when in position interconnecting harness B with hand A, the strap, the forearm and the hand to include the fingers of the player extend substantially along a single longitudinal plane. FIG. 1 clearly shows the relative positioning of these members. Strap C is adjusted to a length so that when the elbow is pointed generally towards the basket and bent, the wrist of the corresponding arm is held in the cocked position as seen in FIG. 2 with the palm of the hand facing the target or basket and the fingers held generally perpendicular. The strap C, the forearm and the hand retain their longitudinal alignment. As the player shoots the ball, the shooting arm is extended and the wrist flips with the hand including the fingers pivoting about the wrist, directing the ball toward the basket against the force of elastic strap C as seen in FIG. 3. Upon completion of the shot, training device 10 through strap C returns forearm and wrist to the proper preshooting position as seen in FIG. 2. The training device may be used to practice the proper shooting motion without the use of a ball. By going through the shooting motion, pressures are applied at the proper points to maintain the forearm and hand in proper positions. Upon completion of the pantomime shooting motion, the forearm and hand are returned to the proper preshooting position with the wrist properly cocked.

While a preferred embodiment of the invention has been described using specific terms, such description is for illustrative purposes only, and it is to be understood that changes and variations may be made without departing from the spirit or scope of the following claims.

What is claimed is:

1. A basketball training device for developing proper technique of shooting a basketball toward a target by a basketball player by developing proper arm and hand positions in an initial position and an extended position said device comprising:

an arm band constructed to be secured above a forearm and about the corresponding upper arm of said player;

a finger harness having a pair of openings constructed to receive an index finger and a middle finger of the corresponding hand of said player;

a yieldable tension member constructed and arranged to extend continuously substantially in longitudinal alignment with said forearm and hand, while interconnecting said band and said harness;

said tension member being constructed of a length and connected at said arm band and finger harness so that when said tension member is tensioned in said extended position a pull is exerted which tends to bend said arm at its elbow which returns said forearm toward said upper arm while cocking the wrist to its initial position with the palm of the hand facing the target.

2. The device according to claim 1 wherein said arm band comprises an elongate non-elastic member having opposite ends and means adjustably securing said arm band to form a loop about said upper arm.

3. The device according to claim 2 wherein said elongate member is approximately three inches in width.

4. The device according to claim 2 wherein said securing means comprises a buckle assembly carried near one end of said elongate member and a belt carried by the opposite end of said elongate member extending from an opposite end of said elongate member, said belt being of a sufficient length as to extend beyond said opposite end so as to be interconnectable with said buckle.

5. The device according to claim 2 wherein means are provided to connect a ring to one edge of said elongate member, said yieldable tension member extending through said ring.

6. The device according to claim 1 wherein said yieldable tension member comprises an elastic strap.

7. The device according to claim 6 wherein said elastic strap is provided with buckle means secured adjacent one end thereof, said buckle is adapted to receive an opposite end of said strap so as to form a loop of adjustable length.

8. The device according to claim 7 wherein said arm band is inelastic so as not to stretch when placed under a tensioning force by said yieldable tension member.

9. The device according to claim 1 wherein said arm band is inelastic so as not to stretch when placed under a tensioning force by said yieldable tension member.

10. The device according to claim 1 including a ring carried by said arm band adapted to receive said yieldable tension member.

11. A basketball training device for developing proper technique of shooting basketball toward a target by a basketball player by developing proper arm and hand positions in an initial position and an extended position said device comprising:

an arm band constructed to be secured above a forearm and about the corresponding upper arm of said player;

a finger harness constructed to receive an index finger and a middle finger of the corresponding hand of said player;

a yieldable tension member constructed and arranged to extend continuously substantially in longitudinal alignment with said forearm and hand while, interconnecting said band and said harness;

said tension member being constructed of a length and connected at said arm band and finger harness so that when said tension members is tensioned in said extended position a pull is exerted which tends to bend said arm at its elbow which returns said forearm toward said upper arm while cocking the wrist to its initial position with the palm facing the target;

wherein said finger harness comprises a flat piece of material having separation means for separating said index and middle finger; said separation means include a first aperture adapted to receive the index finger and the second aperture adapted to receive said middle finger.

12. The device of claim 11 wherein said yieldable tension member is adapted to be connected to said arm band and said finger harness at points so as to extend substantially parallel with said forearm when said hand and arm move between said initial and extended shooting positions.

13. The device of claim 12 wherein said yieldable. tension member includes an elastic strap which is adjustable in its length.

14. The device of claim 13 wherein said elastic strap comprises a loop of elastic material; and fastening means for adjusting the overall length of said loop to adjust the tension of said yieldable tension member during said shooting motion.

15. The device of claim 13 wherein said arm connector means comprises an inelastic elongate member which encircles an upper arm of said basketball player above an elbow of said basketball player, and means for securing said inelastic member tightly about said upper arm so that said elongate member remains in place under tension by said yieldable tension member during said shooting motion.

* * * * *